US005247988A

United States Patent [19]

Kurzinski

[11] Patent Number: 5,247,988

[45] Date of Patent: Sep. 28, 1993

[54] APPARATUS AND METHOD FOR CONTINUOUSLY CASTING STEEL SLABS

[76] Inventor: Cass R. Kurzinski, 305 Buffington Rd., Syracuse, N.Y. 13223

[21] Appl. No.: 742,478

[22] Filed: Aug. 5, 1991

Related U.S. Application Data

[63] Continuation of Ser. No. 382,667, Dec. 19, 1989, abandoned.

[51] Int. Cl.[5] ..... B22D 11/124

[52] U.S. Cl. ..... 164/485; 164/455; 164/414

[58] Field of Search ..... 164/414, 443, 455, 485

[56] References Cited

U.S. PATENT DOCUMENTS

| | | | |
|---|---|---|---|
| 3,511,305 | 5/1970 | Wertli | 164/485 |
| 4,006,633 | 2/1977 | Shipman | 164/414 |
| 4,494,594 | 1/1985 | Kurzinski | 164/443 |

FOREIGN PATENT DOCUMENTS

| | | | |
|---|---|---|---|
| 8605724 | 10/1986 | PCT Int'l Appl. | 164/436 |
| 835614 | 7/1981 | U.S.S.R. | 164/436 |

OTHER PUBLICATIONS

Iron and Steel Engineer, Jul. 1982, pp. 59–60.

*Primary Examiner*—Richard K. Seidel
*Assistant Examiner*—Rex E. Pelto
*Attorney, Agent, or Firm*—Dennis H. Lambert

[57] ABSTRACT

In a continuous casting mold for casting slabs of metal, the mold is cooled by sprays of coolant directed against the outside of the mold. The mold (11) is divided into four zones (zones 1, 2, 3 and 4) and the rates of heat extraction in the different zones are varied so as to obtain a substantially uniform rate of cooling and solidification of the metal being cast, thereby reducing or eliminating the incidence of face cracking in the cast slab.

8 Claims, 2 Drawing Sheets

APPARATUS AND METHOD FOR CONTINUOUSLY CASTING STEEL SLABS

This is a continuation of copending application Ser. No. 07/382,667 filed on Dec. 19, 1989 now abandoned.

DESCRIPTION

1. Technical Field

This invention relates to high temperature metal continuous casting machines in which the mold tubes are cooled with sprayed water or other coolant during a casting operation. More particularly, in accordance with the present invention an apparatus and method are disclosed for the controlled cooling of a thin slab mold with a sprayed coolant.

2. Background Art

In the conventional continuous steel casting method, molten steel is passed through a vertically oriented, usually curved, copper mold. As the molten steel passes through the mold its outer shell hardens. As the steel strand continues to harden, it is bent through an angle of 90° so that it moves horizontally, and it is subsequently cut into individual slabs.

The temperature of molten steel is typically 2850° F., although with certain grandes the temperature may be as low as 2600° F. In general, although most of the references herein are to steel casting, the invention contemplates the casting of any metal or metal alloy whose liquid temperature exceeds 2600° F.

The mold which forms the steel strand contains the liquid steel and provides for its initial solidification, that is, hardening of the outer shell. The solidifying strand is extracted continuously from the bottom of the mold at a rate equal to that of the incoming liquid steel at the top, the production rate being determined by the time required for the outer shell to harden sufficiently so as to contain the inner core of liquid, solidifying steel.

Present day continuous casting machines for slab shapes (usually rectangular, two inches or more in thickness and thirty to one hundred inches in width) employ a conventional flowing sheet of water and baffle tube arrangement for initiating cooling in the copper mold. This method of cooling has been found to be particularly troublesome when casting slabs due to the inability for controlled heat extraction (expressed in BTU/min.) inherent with the conventional mold cooling system employed. Specifically, since the corners of the slab are exterior angles they have a tendency to cool faster than the broad faces. The contraction caused by non-uniform cooling often results in cracks in the middle of the broad face of the slab, and other exterior and interior cracking problems.

The greater the width to thickness ratio, the greater the propensity for broad face cracks to develop on the cast slab. Generally, when the width to thickness ratio exceeds 12 to 1 the slab becomes particularly crack sensitive (referred to as Face Crack Propensity, FCP). Solidification and cracking control via heat extraction control in a conventionally designed mold likewise becomes increasingly more difficult in proportion to the width to thickness ratio as noted above. When this ratio exceeds 30 to 1 or when the slab thickness is less than 1.25 inches, it is extremely difficult to control the FCP using conventionally cooled molds and requires extraordinary measures by operating personnel, including a significant reduction in casting speed, deterioration in the casting machine's production capacity and deterioration of the quality of the cast product. Machine operation must often cease following the initiation of a crack since all measures to stop further crack propogation cannot effectively control BTU removal within the mold itself.

DISCLOSURE OF THE INVENTION

Applicant has discovered that controlling the cooling rate or BTU removal in different zones of a slab casting mold according to predetermined parameters enables the FCP to be controlled without adversely affecting production capacity of the machine. By employing a spray cooling technology such as described in U.S. Pat. No. 4,494,594 it is possible to accurately control the heat extraction rate of any size cast slab and thereby control FCP even beyond the conventional limiting ratio of width to thickness of 30 to 1 or the limiting minimum thickness of 1.25 inches. In fact, using the apparatus and method of the invention, it is possible to successfully cast slabs with width to thickness ratios of 100 to 1 or greater and/or thicknesses of less than 1 inch. By monitoring the quantity of heat (BTU/min.) being extracted at various zones on the outside surface of the casting mold, it is possible to control FCP without adversely affecting the production capacity of the machine. In fact, by controlling the BTU/min. removal it is now possible to also beneficially influence cast strand quality. Basically, the slab mold is divided for control purposes into four (4) cooling zones identified as:

| | |
|---|---|
| ZONE 1 | Corner Zone: extending the entire length of the mold, from the edge of the mold approximately two inches on both sides of the mold; |
| ZONE 2 | Upper Mid-Face Zone: extending from the top of the mold to a point six (6) inches below the meniscus on both faces of the mold; |
| ZONE 3 | six (6) inches below the meniscus to a point approximately two-thirds of the way down the mold on both faces thereof; Middle Mid-Face Zone: extending from six (6) inches below the meniscus to a point approximately two-thirds of the way down the mold on both faces thereof; |
| ZONE 4 | Lower Mid-Face Zone: extending from approximately the two-thirds point noted for the lower end of zone 3 to the exit end of the mold on both faces thereof. |

Proper BTU/min. heat removal is controlled by selecting various flow-rate spray nozzles and grouping or "banking" them together in positions relative to the mold and to each other according to predetermined parameters. The flow rate for each nozzle "bank" is then regulated to maintain a specified BTU/min. extraction rate and BTU/min. extraction relationships between the various cooling zones. In practice, as the casting operation progresses, the work crew member monitors the various heat extracting rates and adjusts nozzle flow rates accordingly.

The BTU/min. extraction rate per cooling zone will vary within a specified range depending upon certain casting conditions, such as: casting temperature; casting speed; steel grades to be cast; etc. Each individual operation must be evaluated and specifically determined. However, the extraction ranges to cover most grades and anticipated casting conditions are identified in chart I. Simultaneous heat extraction relationships between zones 1, 2, 3 and 4 are monitored and adjustments are made when the ratios vary from predetermined limits. After the actual operating data are collected, the information can be stored in a computer and then the actual operation of each cooling zone can be automatically controlled via the computer, using temperature sensor probes in various set points within the mold itself and by correlating these measurements with the other operating parameters of the casting machine.

Chart I

| Heat Extraction and Cooling Zone Relationship Chart | | |
|---|---|---|
| Location | Absolute Heat Extraction (BTU/min) | Heat Extraction Relationship to Zone I (maximum) |
| Zone I | 2880–10656 | — |
| Zone 2 | 9600–35520 | 3.6/1.0 |
| Zone 3 | 4800–17760 | 1.6/1.0 |
| Zone 4 | 6720–24864 | 2.5/1.0 |

From the above, it can be seen that the maximum heat extraction occurs in zone 2, from the top of the mold to a point just below the menisucus, and that the next greatest heat extraction occurs in zone 4, extending over about one-third the length of the mold at the exit end thereof. The middle portion of the length of the mold realizes the next greatest heat extraction rate, while the corners (zone I) of the mold experience the lowest heat extraction rate. By following these parameters in the general ranges indicated, a slab can be cast with superior metallurgical quality and with face cracking eliminated or significantly reduced over prior art methods.

Consequently, an object of this invention is to provide a method and apparatus for casting slabs of steel in a manner to eliminate or significantly reduce face cracking in the cast slab.

Another object is to provide a method of casting slabs of metal wherein the mold tube and thus the metal being cast are cooled at different rates over different zones of the mold so as to control or eliminate face cracking and other defects in the cast slab.

A further object of the invention is to provide an apparatus for casting slabs of metal in which the mold tube for casting the slab is cooled with sprays of a coolant fluid directed against the outer surface of the tube, with the coolant sprays being regulated and controlled so that the rate of heat extraction varies over different zones of the mold to thereby reduce or eliminate face cracking and other defects in the cast slab.

A still further object of the invention is to provide a method and apparatus for casting slabs of metal wherein sprays of coolant fluid against the outer surface of the mold are controlled to effect different rates of heat extraction over different zones of the mold, with the least rate of heat extraction occuring at the corners of the mold, so as to reduce or eliminate face cracking in the cast slab.

BRIEF DESCRIPTION OF THE DRAWINGS

The foregoing and other objects and advantages of the invention will become apparent from the following detailed description and accompanying drawings, in which like parts are indicated by like reference characters throughout the several views, and wherein.

BEST MODE FOR CARRYING OUT THE INVENTION

Figure 1:
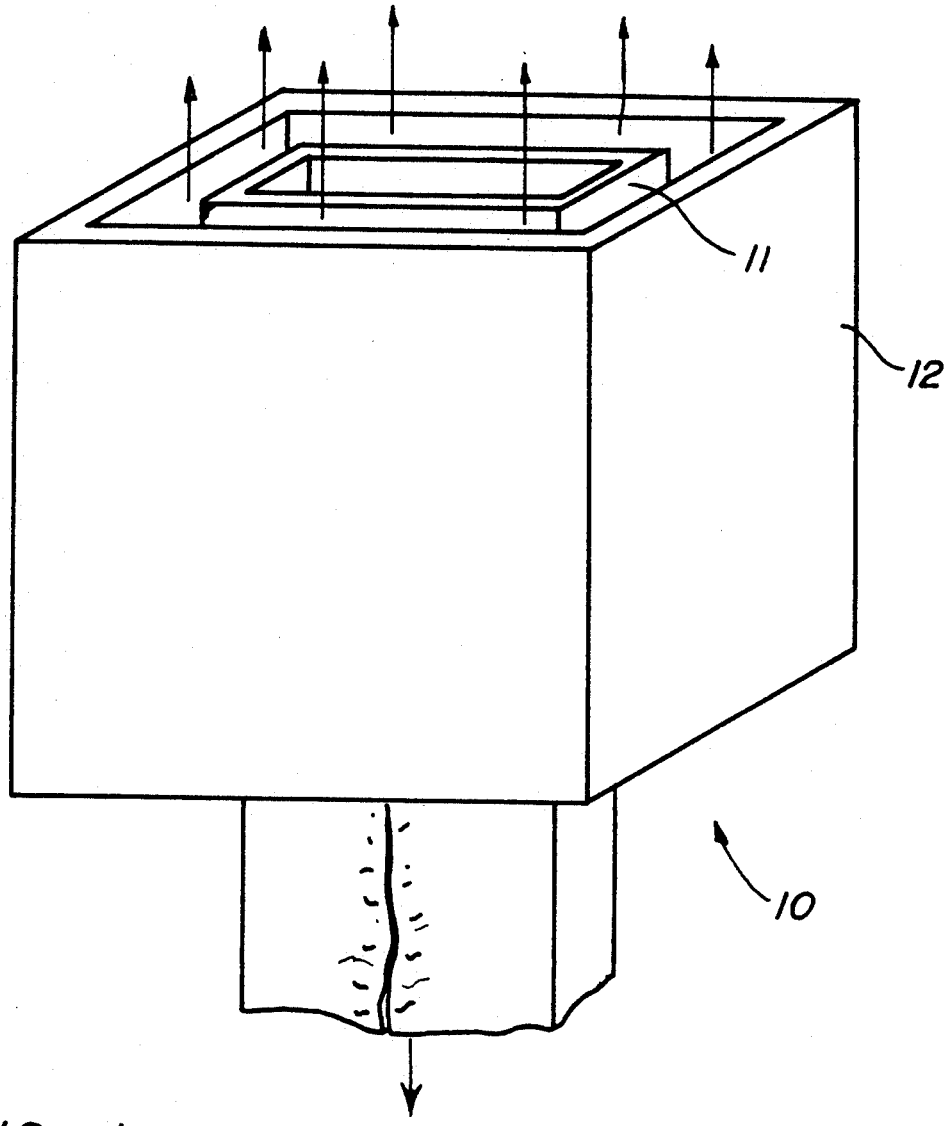
FIG 1 (PRIOR ART)
FIG. 1 is a somewhat schematic perspective view of a prior art slab casting mold apparatus, in which a coolant fluid is circulated over the outside of the mold tube.
Figure 2:
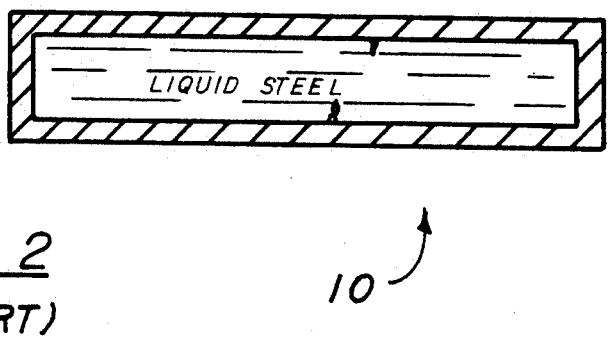
FIG 2 (PRIOR ART)
FIG. 2 is a a schematic end view of the mold tube and slab of FIG. 1.

Referring more specifically to the drawings, typical prior art systems are indicated generally at 10 in FIGS. 1 and 2. In such systems, a cooling fluid, generally water, is caused to circulate over the outside of the mold tube 11 in a direction counter to the flow of molten metal in the mold tube. The cooling water in these systems is confined in a baffle tube arrangement and the cooling rate over different zones of the mold cannot be controlled. Consequently, because of the shape of the mold and the greater exposed area at the corners, a greater rate of heat extraction occurs at the corners with the result that high stress is imposed on the cast slab at its mid-face, causing cracking. When the width W to thickness T ratio equals or exceeds about 12:1 the cast slab is sensitive to cracking, and when the ratio of W to T is equal to or greater than about 30:1 there is a high probability of cracking when slabs are cast with prior art apparatus and methods.

Figure 3:
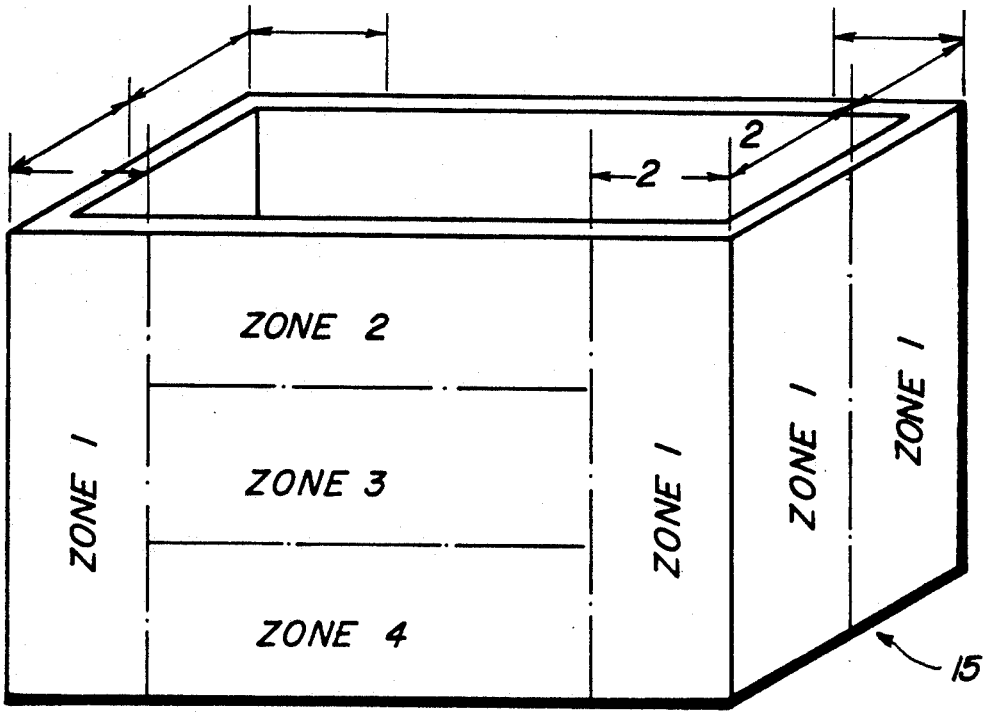
FIG. 3 is a schematic perspective view of a mold tube with the different cooling zones represented thereon in accordance with the present invention.
Figure 4:
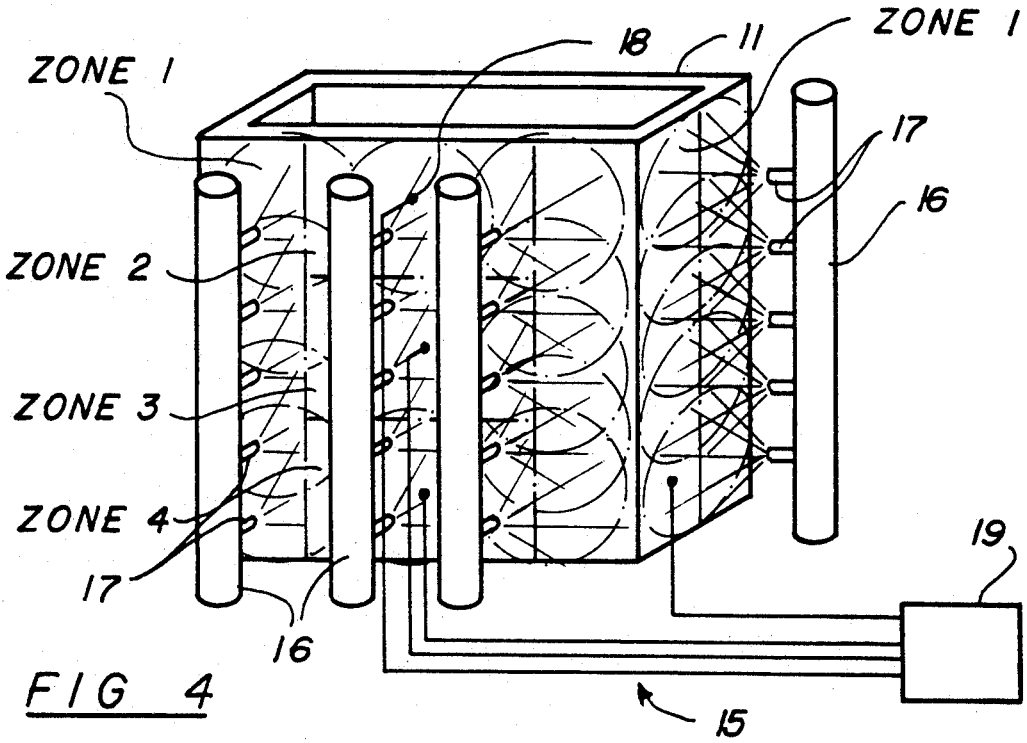
FIG. 4 is a schematic perspective view of a portion of a slab mold with a spray cooling system according to the invention shown in association therewith.
Figure 5:
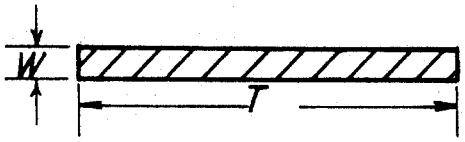
FIG. 5 is a transverse sectional view of a typical slab, showing the width and thickness relationship.

With the present invention, however, as depicted generally at 15 in FIGS. 3 and 4, a spray cooling system 16 is positioned to direct sprays of coolant fluid against the outer surface of the mold tube 11, and the spray nozzles 17 in the spray cooling system are selected with different flow rates and are positioned in "banks" or groupings related to each other and to the mold such that the mold is divided into different zones, i.e., zones 1, 2, 3 and 4, with the rates of heat extraction as expressed in BTU/min being different in the different zones. As shown in Chart I on page 5 herein, the greatest rate of heat extraction occurs in Zone 2, and the lowest rate of heat extraction occurs in Zone 1 (at the corners). These cooling rates are carefully predetermined so that dependent upon the metal being cast, casting speed, casting temperature, etc., the slab will be cooled more uniformly than is possible with prior art systems and stresses will be reduced or eliminated, with the result that cracks will not develop.

Since specific flow rates for the sprays of coolant and specific absolute heat extraction as expressed in BTU/-min will vary with the parameters noted above, the limitations posed herein are expressed in ranges over the different zones and specific values are not given. However, it is believed that the ranges given will encompass most, if not all, situations for most grades of steel and anticipated casting conditions as noted herein.

Further, as noted above it is possible with the invention to utilize sensor probes 18 strategically positioned in the mold itself to measure various parameters such as temperature, and via a computer 19 programmed to respond to the sensed conditions control the flow rates of the coolant being sprayed on the different zones of the mold to thereby regulate the rates of heat extraction in the zones so that a cast slab of superior quality is obtained.

While the invention has been illustrated and described in detail herein, it is to be understood that various changes in construction and operation can be made without departing from the spirit thereof as defined by the scope of the claims appended hereto.

I claim:

1. A method of continuously casting thin slabs of metal having a substantially greater width then thickness, comprising the steps of:

causing molten metal to flow through a mold tube having a cross-sectional shape corresponding to the cross-sectional shape of the slab being cast, said mold tube including an inlet, an outlet, relatively wide opposite faces, relatively narrow opposite sides edges and opposite corners, and said molten metal defining a meniscus zone as it flows through the mold tube;

dividing the surface of the mold tube into a plurality of different cooling zones, including a first cooling zone extending completely over the length and width of each side edge and over small, adjacent portion of the width of each face along the entire length of the face, and a plurality of additional cooling zones arrayed along the length of each face of the mold from the inlet to the outlet thereof, said additional cooling zones each extending completely across the width of each face of the mold between said first cooling zones at the edges, and each extending over only a portion of the length of the mold;

predetermining a ratio of the rate of heat extraction in one zone in relation to the rate of heat extraction in another zone to obtain uniform cooling of the cast slab and thereby minimize surface cracks and other casting flaws int he cast slab;

providing cooling means in association with each cooling zone for extracting heat at a different rate in each zone in accordance with said predetermined ratios; and selectively and controllably cooling the mold tube at said different heat extraction rates in the different zones to effect the greatest rate of heat extraction in a cooling zone extending over the relatively wide faces of the mold tube from the inlet to the meniscus zone, and the least rate of heat extraction in the first cooling zone at the relatively narrow side edges of the mold tube.

2. The method as claimed in claim 1, wherein:

said plurality of additional cooling zones include a second zone extending over only a portion of the length of the mold from the inlet end thereof, a third zone extending over a midportion of the length of the mold from the second zone to a position spaced from the outlet end of the mold, and a fourth zone extending from the third zone to the outlet end of the mold.

3. The method as claimed in claim 2, wherein:

the absolute heat extraction in the zones, as expressed in BUT/min, is in the range of from about 2880 to about 10656 in zone one, from about 9600 to abut 35520 in zone two, from about 4800 t about 17760 in zone three, and from about 6720 to about 24684 in zone four.

4. The method as claimed in claim 2, wherein:

said second zone extends from the inlet of the mold to a point approximately six inches below the meniscus, the third zone extends from the bottom of the second zone to a point approximately two-thirds of the way along the length of the mold, and the fourth zone extends from the bottom of the third zone to the exit end of the mold.

5. The method as claimed in claim 4, wherein:

the maximum ratio of heat extraction in zone four to heat extraction in zone one is 2.5/1.0.

6. The method as claimed in claim 2, wherein:

the rate of heat extraction is greatest in zone two and least in zone one.

7. The method as claimed in claim 2, wherein:

the maximum ratio of heat extraction in zone two to heat extraction in zone one is 3.6/1.0.

8. The method as claimed in claim 2, wherein:

the maximum ratio of heat extraction in zone three to heat extraction in zone one is 1.6/1.0.

* * * * *